United States Patent [19]

Kasarsky et al.

[11] Patent Number: 4,834,616

[45] Date of Patent: May 30, 1989

[54] MEANS AND METHOD FOR SECURING A COMPOSITE ROTOR BLADE

[75] Inventors: James L. Kasarsky, Rockford; John F. Scanlon, Roscoe; John Church; Gary Wigell, both of Rockford, all of Ill.

[73] Assignee: Sundstrand Corporation, Rockford, Ill.

[21] Appl. No.: 868,532

[22] Filed: May 30, 1986

[51] Int. Cl.[4] ..... F04D 29/38

[52] U.S. Cl. ..... 416/229 R; 416/239; 416/248; 29/156.8 B

[58] Field of Search ..... 416/204 R, 210 R, 229 R, 416/229 A, 230 R, 230 A, 239, 241 A, 248; 29/156.8 B, 156.8 H

[56] References Cited

U.S. PATENT DOCUMENTS

| | | | |
|---|---|---|---|
| 1,147,233 | 7/1915 | Gibson | 416/230 |
| 1,620,968 | 3/1927 | Heath | 416/205 |
| 3,021,246 | 2/1962 | Hutter et al. | 156/196 |
| 3,603,701 | 9/1971 | Tarcrynski | 416/204 |
| 3,701,611 | 10/1972 | Lambrecht | 416/241 A X |
| 3,731,360 | 5/1973 | Stone, Jr. | 29/156.8 B |
| 3,799,701 | 3/1974 | Rothman | 416/241 A X |
| 4,031,601 | 6/1977 | Staub et al. | 29/156.8 B |
| 4,040,770 | 8/1977 | Carlson | 416/248 X |
| 4,045,149 | 8/1977 | Ravenhall | 416/135 |
| 4,304,523 | 12/1981 | Corsmeier et al. | 416/221 |
| 4,524,499 | 6/1985 | Grimes et al. | 29/156.8 B |

FOREIGN PATENT DOCUMENTS

| | | | |
|---|---|---|---|
| 52-77909 | 6/1977 | Japan | 416/248 |
| 521402 | 1/1977 | U.S.S.R. | 416/248 |
| 808685 | 2/1981 | U.S.S.R. | 416/229 R |
| 1437236 | 5/1976 | United Kingdom | 416/230 |

*Primary Examiner*—Robert E. Garrett
*Assistant Examiner*—Joseph M. Pitko
*Attorney, Agent, or Firm*—Wood, Dalton, Phillips, Mason & Rowe

[57] ABSTRACT

A self-locking retention system is provided for a composite rotor blade supported on a rotor hub. A radially extending, stud-like retention member is provided on the rotor hub. A composite thickness projects radially inwardly from the rotor blade and substantially surrounds the retention member. The composite thickness is woven in a pattern which grips the retention member in response to outward forces applied to the rotor blade and the woven composite thickness.

22 Claims, 2 Drawing Sheets

FIG. 1
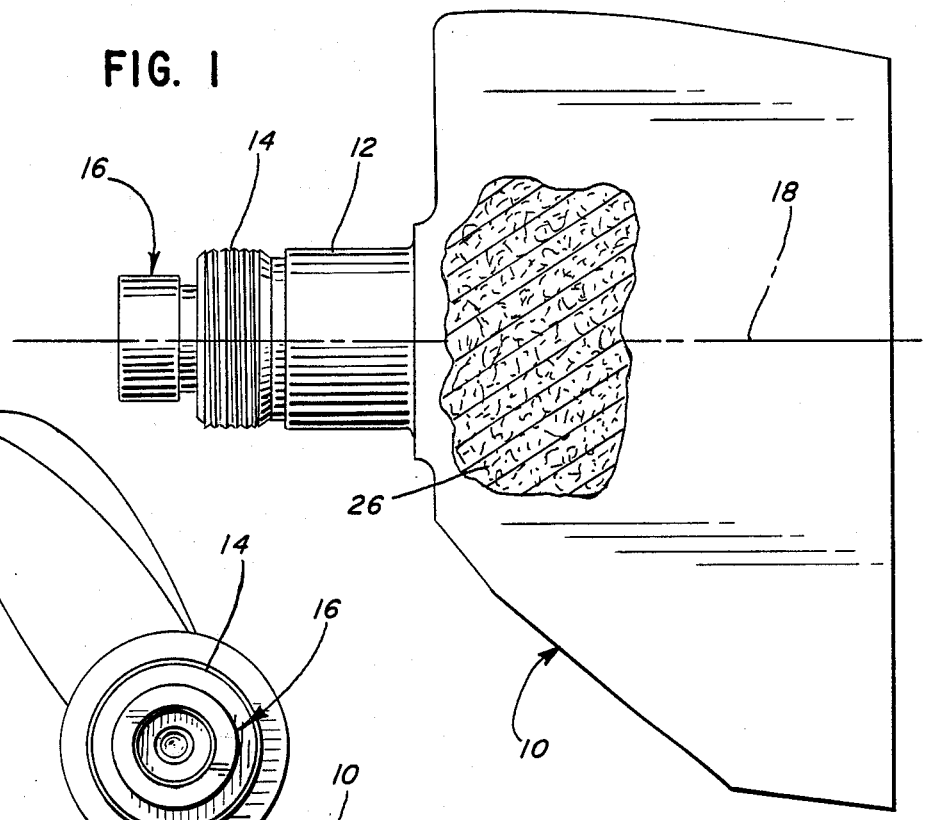
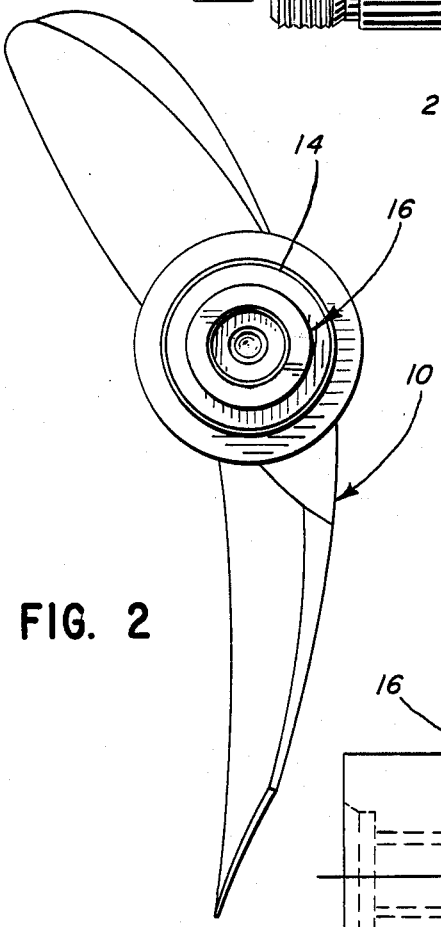
FIG. 2
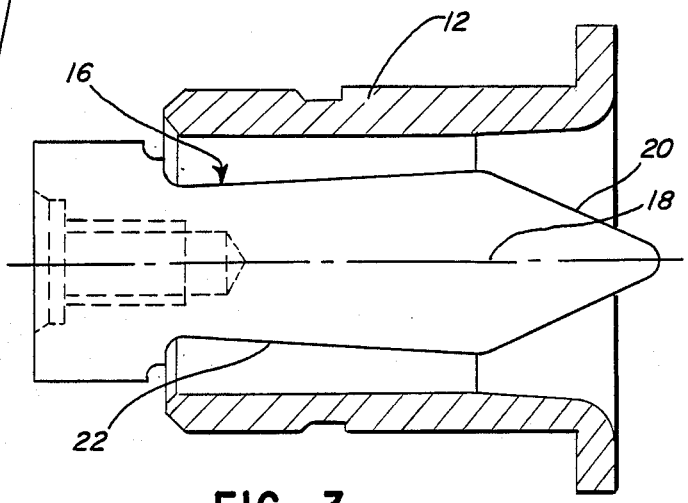
FIG. 3

FIG. 5
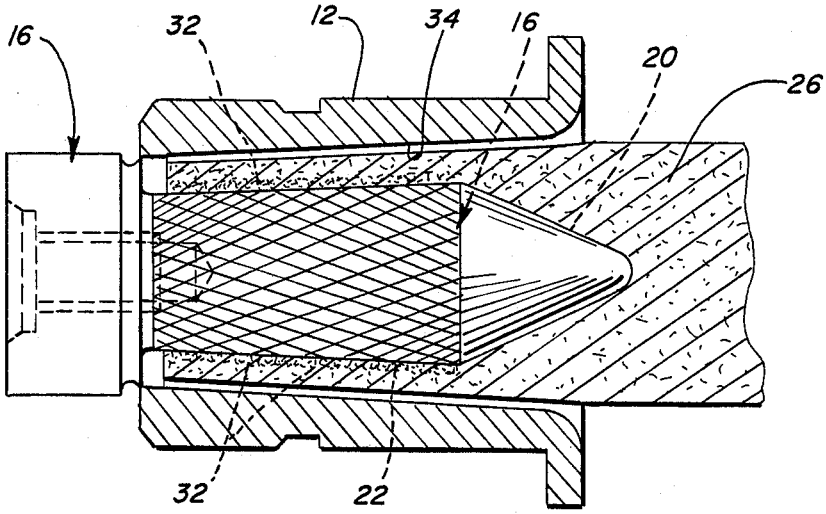
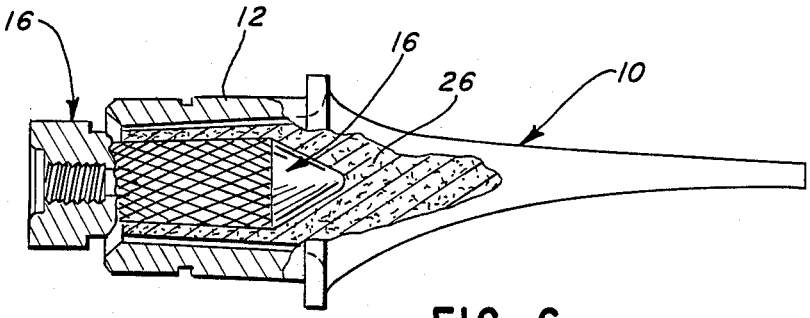
FIG. 6
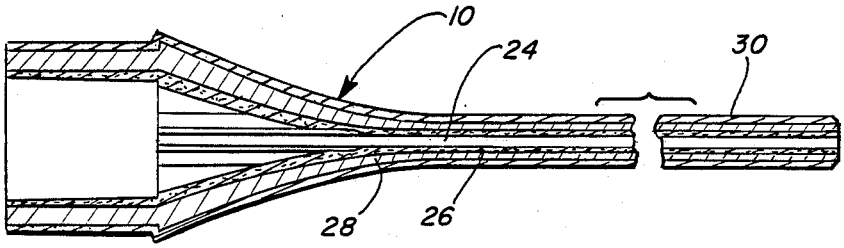
FIG. 4

MEANS AND METHOD FOR SECURING A COMPOSITE ROTOR BLADE

FIELD OF THE INVENTION

This invention generally relates to composite rotor blade retention, and, particularly, to a means and method for retaining a composite rotor blade to a rotor hub.

BACKGROUND OF THE INVENTION AND THE PRIOR ART

Composite rotor blades conventionally are mechanically retained to a rotor hub by a root fitting which effectively transfers dynamic loading from the composite blade structure, through the fitting, to the rotor hub. In rotor blades of advanced composite structure, problems arise in transmitting the dynamic loads to the rotor hub, including the torque, tension and bending loads on the rotor blade which must be transmitted to the rotor hub. In other words, the attachment means provides a path for loads from the composite structure to the rotor hub.

In the case of metallic blades which are retained for rotation upon the periphery of the rotor hub, a wide variety of mechanical fittings or attachment means are available and are quite effective. However, the trend toward incorporating composite blades into rotor assemblies has produced unique problems not heretofore experienced. By the term "composite blades" it is meant those blades formed by laminating multiple plies of elongated, small diameter filaments of high strength, i.e. high modulus of elasticity, embedded in a lightweight matrix. Typical examples are the non-metallic composites such as graphite filaments in an epoxy resin, and certain metallic composites in a matrix such as aluminum.

The interface of composite materials in rotor blades to metallic elements of the rotor hub has been analytically and experimentally shown to be the crucial link in making composite rotor blade assemblies. This is the area where most problems occur, i.e. the area of transmitting the dynamic loads on the composite rotor blade to the metallic rotor hub. In the past, spade-type configurations have been used for the composite-to-metallic interface. Fibers from the composite blade simply have been wound around the spade and bonded thereto with a resin. However, during fatigue life testing, the resin bonded to the metallic spade tends to separate and fail at that interface.

A variety of attempts have been made to solve the above problems, some of which are shown in U.S. Pat. Nos. 3,603,701 to Tarcrynski, dated Sept. 7, 1971; 3,731,360 to Stone, Jr., dated May 8, 1973; and 4,031,601 to Staub, dated June 28, 1977. Tarcrynski shows a system for transferring the dynamic loading forces from a composite rotor blade held between opposing external and internal metallic fittings, with a lock nut in communication with a key to transmit torque from the internal fitting by a preloading scheme. Stone shows a method of making a composite blade with an integral root, in a compacting and bonding operation, and positioning a wedge between spread layers of the composite blade structure at the root end thereof. Staub shows a rather complicated dovetail slot interface between a fiberglass blade and a hub, including forcing additional, substantially liquified resin and fiberglass material through a bore in the hub fitting.

This invention is directed to providing a new and improved system for retaining a rotor blade on a rotor hub in which a gripping action occurs and the retention forces actually increase in response to dynamic loading forces on the blade.

SUMMARY OF THE INVENTION

An object of the invention, therefore, is to provide a new and improved self-locking retention means for a rotor blade supported on a rotor hub, such as a hub having a socket or the like for receiving the root end of the blade.

Another object is to provide a method of making a self-locking retention means of the character described.

Generally, the self-locking retention means includes a retention member on the rotor hub. A composite rotor blade includes a composite thickness extending inwardly beyond the root end of the blade and substantially surrounding the retention member. The composite thickness is woven in a pattern which effects radially inward gripping forces on the retention member automatically in response to forces applied to the composite thickness in a direction away from the retention member. Therefore, the composite thickness grips the retention member in a self-locking action in response to the outward forces applied to the rotor blade and the woven composite thickness.

More specifically, the illustrated embodiment provides a radially extending, stud-like retention member on the rotor hub. The woven composite thickness is generally tube-shaped and projects radially inwardly from the rotor blade for surrounding the stud-like retention member. The retention member has an interference formed by a tapered outer surface diverging away from the root end of the blade, the tapered surface being knurled. Chopped fiber material is sandwiched between the outer surface of the retention member and the woven composite thickness. The hub fitting is shown herein in the form of a socket, and the stud-like retention member comprises an insert extending through the inner end of the socket, with the woven composite thickness sandwiched between the insert and the socket.

The invention contemplates a method of making a self-locking retention means of the character described, wherein the radially inwardly projecting, woven composite thickness is placed under tension to grip the retention member and cured while gripping the member.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is an elevational view of a rotor blade incorporating the self-locking retention means of the invention, partially broken away to illustrate the interior woven composite thickness;

FIG. 2 is an end elevation of the blade of FIG. 1, looking toward the left-hand end thereof;

FIG. 3 is a section, on an enlarged scale, illustrating the socket for the rotor hub and the retention insert;

FIG. 4 is a fragmented section through the composite rotor blade of the invention;

FIG. 5 is an axial section, similar to that of FIG. 3, but illustrating the location of the self-locking woven composite thickness of the rotor blade; and FIG. 6 is an elevational view of the completed rotor blade assembly, partially broken away to illustrate the interior components.

DETAILED DESCRIPTION OF THE PREFERRED EMBODIMENT

Referring to the drawings in greater detail and particularly to FIGS. 1–3, the self-locking rotor blade retention means of the invention is illustrated in a rotor blade, generally designated 10, such as a blade for a RAM air turbine engine. The blade is a composite structure integrally formed with a socket 12 of metallic material or the like. The socket has a threaded connection 14 for mounting on an appropriate rotor hub. A retention member, generally designated 16, is positioned within socket 12 as best illustrated in FIG. 3.

Retention member 16 comprises a stud-like insert positionable within socket 12 on an axis 18 of rotor blade 10. The insert is generally circular in cross-section and includes a frusto-conical forward end 20 and a tapered outer surface 22 diverging away from the root end of rotor blade 10. Tapered outer surface 22 provides an interference means as will be described in greater detail hereinafter.

Referring to FIG. 4, rotor blade 10 comprises a composite structure formed by laminating multiple plies or layers to provide high strength or a high modulus of elasticity for the rotor blade. More particularly, the blade is fabricated with an inner core 24, a composite thickness of woven material 26 about the core, an outer layer 28 and, finally, a single covering layer 30. Inner core 24 may be fabricated of a closed cell foam. Composite thickness 26 is a woven composite as described hereinafter. Outer layer 28 is formed of a composite of graphite filaments and epoxy resin matrix. Covering layer 30 is formed of a single ply of glass filaments with an epoxy resin matrix.

Referring to FIG. 5, the invention comprehends extending woven composite thickness 26 (FIG. 4) radially inwardly to surround retention insert 16. The composite thickness is woven in a generally tube shape at this point for substantially surrounding the retention insert and covering the tapered outer surface 22 which, as described above, diverges away from the root end of the rotor blade. Tapered surface 22 is knurled, and chopped fiber material 32 is sandwiched between the knurled surface and the surrounding woven composite 26. The woven composite thickness may comprise a plurality of layers. As seen in FIG. 5, the tubular woven composite thickness essentially is sandwiched between the outer tapered surface 22 of retention insert 16 and an internal cylindrical passage 34 through socket 12.

FIG. 6 shows the completed rotor blade assembly with the blade composite structure as illustrated in FIG. 4 assembled to retention insert 16 and socket 12.

Woven composite thickness 26 comprises graphite fibers, within an epoxy resin matrix, woven in a "diamond" configuration weave and placed over knurled tapered surface 22 of retention insert 16. Technically, the diamond configuration of the weave is termed a triaxial weave pattern. Chopped fiber 32 is sandwiched between knurled surface 22 and the woven composite thickness, and the materials are cured together. The invention contemplates this method of fabrication and includes placing woven composite insert 26 in tension, i.e. applying a radially outward force to the woven composite thickness, with the entire blade assembly, retention insert and socket cured while the woven composite thickness is maintained in tension by appropriate tools at the distal end of the composite rotor blade.

In operation, the rotor blade retention means, i.e. the composite-to-metallic interface, has to withstand centrifugal outward forces, aero-bending moments and centrifugal and aero-dynamic twisting moments. All of these loads are transmitted through the composite-to-metal interface and, therefore, it can be seen that the self-locking retention means of this invention is considered a most crucial aspect of designing composite rotor or propeller blades.

With the triaxially woven composite thickness 26 of this invention, as the centrifugal outward forces become greater, the tighter the weave becomes and the harder the composite thickness clamps onto the metallic retention insert 16, thus providing a self-locking feature and load paths from the composite to the metal fitting. The insert is knurled to transmit the centrifugal and aero-twisting moments. The chopped fiber 32 sandwiched between the woven composite thickness and the knurled insert reduces the stress concentration factor caused by the insert being knurled.

As stated hereinbefore, by tapering surface 22 of retention insert 16, an interference means is provided to enhance the gripping action of woven composite thickness 26 on the insert. Although ribs or other interference means might be applicable in certain situations, the tapered surface is preferred because such interference means as ribs might cause stress points. The tapered surface has a greater area of positive retention than more concentrated means. In other words, the load path or the stress is more evenly distributed.

In essence, the use of a composite thickness running from the rotor blade into the rotor hub interface connection, with the novel weave pattern, effects radially inward gripping forces on retention insert 16 automatically in response to axial linear or twisting forces applied to the woven composite thickness in a direction away from the retention insert. Therefore, the woven composite thickness provides a self-locking feature between the rotor blade and the rotor hub which heretofore has not been available.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A self-locking retention means for a rotor blade supported on a rotor hub having a socket or the like for receiving the root end of the blade, comprising:

a retention member on said rotor hub; and a composite rotor blade including a composite thickness extending inwardly beyond the root end of the blade and substantially surrounding the retention member, said thickness being woven in a pattern which effects radially inward gripping forces on the retention member automatically in response to axially linear forces applied to the woven composite thickness in a direction away from the retention member to thereby self-lock the woven composite thickness and, therefore, the rotor blade to the retention member and rotor hub.

2. The rotor blade retention means of claim 1 wherein said retention member includes interferences means at the interface between said woven composite thickness and the retention member.

3. The rotor blade retention means of claim 2 wherein said interference means comprises forming the retention member with a tapered outer surface diverging away from the root end of the blade.

4. The rotor blade retention means of claim 3 wherein said tapered surface is knurled.

5. The rotor blade retention means of claim 1 wherein said retention member comprises an insert positioned within said socket, with the woven composite thickness located therebetween.

6. The rotor blade retention means of claim 5, including chopped fiber material sandwiched between the insert and the woven composite thickness.

7. The rotor blade retention means of claim 1, including chopped fiber material sandwiched between the retention member and the woven composite thickness.

8. The rotor blade retention means of claim 1 wherein said woven composite thickness is woven generally in tubular shape to substantially surround the retention member.

9. The rotor blade retention means of claim 8 wherein said composite thickness is woven in a triaxial pattern.

10. The rotor blade retention means of claim 9 wherein said retention member has a tapered exterior surface diverging away from the root end of the blade.

11. The rotor blade retention means of claim 10 wherein said tapered surface is knurled.

12. The rotor blade retention means of claim 11, including chopped fiber material sandwiched between the retention member and the woven composite thickness.

13. A self-locking retention means for a composite rotor blade supported on a rotor hub, comprising:

a radially extending, stud-like retention member on the rotor hub; and a composite thickness projecting radially inwardly from the rotor blade and substantially surrounding the retention member, said composite thickness being woven in a pattern which grips the retention member in response to outward forces applied radially to the rotor blade and the woven composite thickness.

14. The rotor blade retention means of claim 13 wherein said retention member has a tapered exterior surface diverging away from the root end of the blade.

15. The rotor blade retention means of claim 14 wherein said tapered surface is knurled.

16. The rotor blade retention means of claim 15, including chopped fiber material sandwiched between the retention member and the woven composite thickness.

17. The rotor blade retention means of claim 14 wherein said woven composite thickness is woven generally in tubular shape to substantially surround the retention member.

18. The rotor blade retention means of claim 17 wherein said composite thickness is woven in a triaxial pattern.

19. A method of making a rotor blade assembly having a rotor hub, comprising the steps of:

providing the rotor hub with a radially extending, stud-like retention member;

laying up a composite rotor blade including a composite thickness projecting radially inwardly of the rotor blade and being woven in a pattern to grip the retention member in response to radially outward forces applied to the composite thickness;

positioning the composite thickness about the retention member;

applying a radially outward force to the woven composite thickness whereby the thickness grips the retention member; and curing the woven composite thickness while gripping the retention member.

20. The method of claim 19, including positioning chopped fiber material between the woven composite thickness and the retention member before curing.

21. The method of claim 19 wherein said woven composite thickness is woven in a tubular shape.

22. The method of claim 21 wherein said woven composite thickness is woven in a triaxial pattern.

* * * * *